US012605602B1

(12) United States Patent
Kline

(10) Patent No.: US 12,605,602 B1
(45) Date of Patent: Apr. 21, 2026

(54) BAT SWING TRAINING AID

(71) Applicant: Jason Kline, Chaffee, NY (US)

(72) Inventor: Jason Kline, Chaffee, NY (US)

( * ) Notice: Subject to any disclaimer, the term of this patent is extended or adjusted under 35 U.S.C. 154(b) by 0 days.

(21) Appl. No.: 18/971,401

(22) Filed: Dec. 6, 2024

(51) Int. Cl.
*A63B 69/00* (2006.01)
*A63B 59/50* (2015.01)
*A63B 60/02* (2015.01)

(52) U.S. Cl.
CPC ..... *A63B 59/50* (2015.10); *A63B 60/02* (2015.10); *A63B 69/0002* (2013.01); *A63B 2069/0008* (2013.01)

(58) Field of Classification Search
CPC ..... A63B 59/50; A63B 60/02; A63B 69/0002; A63B 2069/0008
USPC ..... 473/457, 564, 464
See application file for complete search history.

(56) References Cited

U.S. PATENT DOCUMENTS

| | | | | |
|---|---|---|---|---|
| 1,499,128 | A | 6/1924 | Shroyer, Jr. | |
| 2,379,006 | A | 6/1945 | Johnson | |
| 3,116,926 | A | 1/1964 | Owen et al. | |
| 3,392,976 | A | 7/1968 | Hayes | |
| 3,578,801 | A * | 5/1971 | Piazza | A63B 15/005 473/457 |
| 3,877,698 | A | 4/1975 | Volpe | |
| 4,898,386 | A | 2/1990 | Anderson | |
| 5,277,421 | A | 1/1994 | Rewolinski | |
| 5,494,280 | A | 2/1996 | Mackay, Jr. | |
| 6,692,386 | B2 * | 2/2004 | Brundage | A63B 59/56 473/519 |
| 6,767,299 | B1 | 7/2004 | Chang | |
| 6,918,843 | B1 | 7/2005 | Franssen | |
| 7,056,240 | B2 * | 6/2006 | Brock | A63B 69/0002 473/422 |
| 7,198,581 | B1 | 4/2007 | Black | |
| 7,261,654 | B2 * | 8/2007 | Cheng | A63B 59/50 473/457 |
| 8,821,323 | B2 * | 9/2014 | Liu | A63B 59/50 473/422 |
| 8,827,846 | B2 * | 9/2014 | Shocklee | A63B 60/10 473/453 |
| 8,888,614 | B2 * | 11/2014 | Nutter | A63B 59/50 473/437 |
| 9,943,740 | B2 | 4/2018 | Mayers, III et al. | |
| 10,561,913 | B2 | 2/2020 | Burger et al. | |
| 11,167,191 | B2 | 11/2021 | Anderle et al. | |
| 2005/0202908 | A1 | 9/2005 | Haynes | |
| 2007/0173358 | A1 | 7/2007 | Gallagher | |
| 2011/0143870 | A1 | 6/2011 | Schulte | |
| 2014/0274493 | A1 | 9/2014 | Heussner | |

(Continued)

*Primary Examiner* — Mitra Aryanpour
(74) *Attorney, Agent, or Firm* — Woods Oviatt Gilman LLP; Dennis B. Danella, Esq.

(57) ABSTRACT

A bat swing training aid is provided. The bat swing training aid includes a bat including a first longitudinal axis. The bat comprises a handle portion; a barrel portion having an outer wall defining a first cavity, wherein the barrel portion includes a first end and a second end, and wherein the second end provides access to the first cavity; a tapered portion disposed between and connecting the first end of the barrel portion and the handle portion; an end cap configured to be removably coupled with the second end of the barrel portion; and an insertable adjustment member configured to be disposed in the first cavity and secured between the tapered portion and the end cap.

26 Claims, 4 Drawing Sheets

(56) References Cited

U.S. PATENT DOCUMENTS

| | | | |
|---|---|---|---|
| 2018/0169491 | A1 | 6/2018 | Gray et al. |
| 2019/0126117 | A1 | 5/2019 | Franco |

* cited by examiner

BAT SWING TRAINING AID

TECHNICAL FIELD

The present invention relates to a baseball training aid; and more particularly relates to a system and a device that can be used to assist a person increase their swing speed when swinging a baseball or softball bat.

BACKGROUND OF THE INVENTION

Baseball and softball are bat and ball games in which a bat is used to strike a ball and advance runners around a set of four bases. The bat is typically constructed of solid wood or a hollow metal/composite material and includes a barrel, a tapered portion, a handle portion. The barrel is the widest portion of the bat and the portion designed to make contact with the ball. The end of the bat proximate to the barrel may be referred to as the top of the bat, which may include a cap in the case of a metal/composite bat. The opposite end of the barrel tapers down in diameter to a handle, to be gripped when the bat is in use. A knob may also be included at the end of the handle, which is a wider piece designed to keep the bat from slipping from the hands.

It is understood that swing speed determines how fast a ball is going to come off the bat. The faster a player swings the bat, the quicker the ball will leave the bat upon contact which generally increases the chance of getting on base. Training devices have been developed to assist players in practicing their swinging. For example, toroidal weights may be added around the outside of a standard, regulation bat in order to increase torque and provide greater resistance for a user practicing with the weighted bat. These toroidal weights are sometimes referred to as donuts. Accordingly, a weighted bat can allow a user to develop additional strength leading to greater bat swing speed when the user removes the weights. However, the use of a donut may change the center of gravity of a bat in an undesirable manner, may initially slow the swing speed, and, due to its external placement, may inhibit the use of the bat to practice striking a ball.

Accordingly, there exists a need for an improved system and device for modifying the weight and center of gravity of the bat to train for increase swing speed while maintaining its functional ability to strike a ball.

SUMMARY OF THE INVENTION

It is, therefore, an aspect of the present invention to provide a bat swing training aid in the form of a bat. The bat includes a first longitudinal axis and comprises a handle portion and a barrel portion having an outer wall defining a first cavity, wherein the barrel portion includes a first end and a second end, and wherein the second end provides access to the first cavity. The bat further comprises a tapered portion disposed between and connecting the first end of the barrel portion and the handle portion. An end cap is configured to be removably coupled with the second end of the barrel portion. Further, an insertable adjustment member is configured to be disposed in the first cavity and secured between the tapered portion and the end cap.

Another aspect of the present invention provides a bat swing training system. The system includes a bat including a first longitudinal axis and comprising: a handle portion; a barrel portion having an outer wall defining a first cavity, wherein the barrel portion includes a first end and a second end, and wherein the second end provides access to the first cavity; a tapered portion disposed between and connecting the first end of the barrel portion and the handle portion, and an end cap configured to be removably coupled with the second end of the barrel portion. The system further comprises a plurality of insertable adjustment members each configured to be disposed in the first cavity and secured between the tapered portion and the end cap.

Additional aspects, advantages and novel features of the present invention will be set forth in part in the description which follows and will in part become apparent to those in the practice of the invention, when considered with the attached figures.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DETAILED DESCRIPTION OF THE INVENTION

Figure 1A:
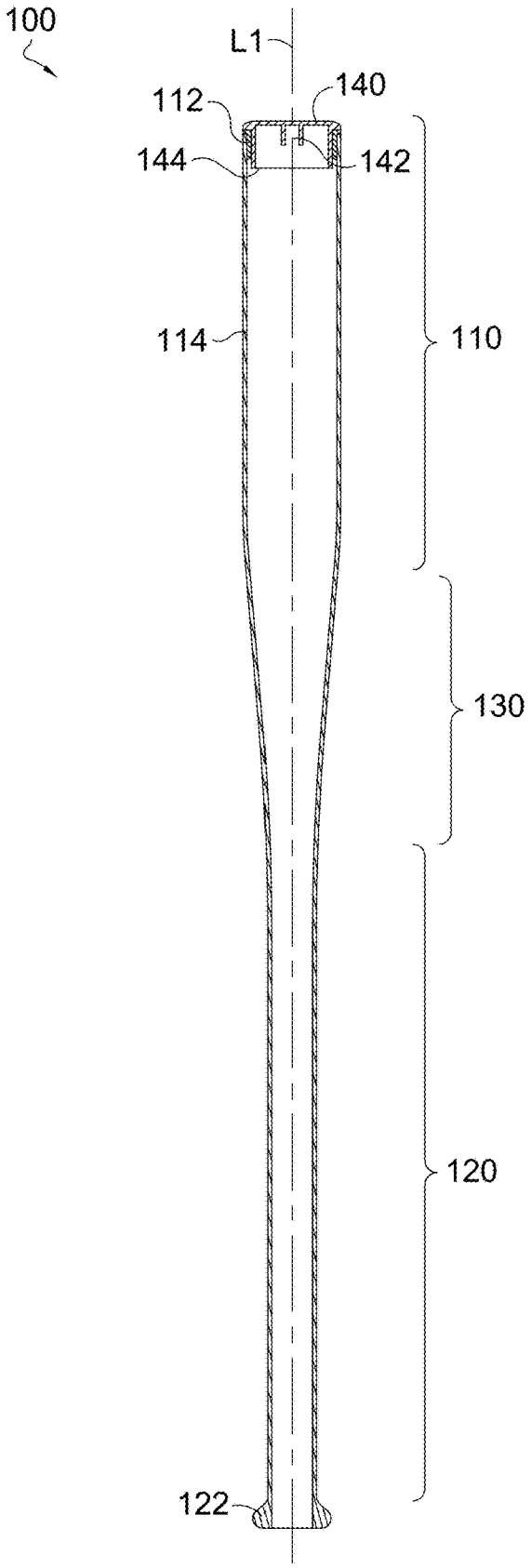
FIGS. 1A and 1B illustrate a cross-sectional view of a bat including a barrel portion with a hollow cavity and an end cap configured to removably couple with and cover an end of the hollow cavity of the barrel portion, in accordance with some embodiments.
Figure 1B:
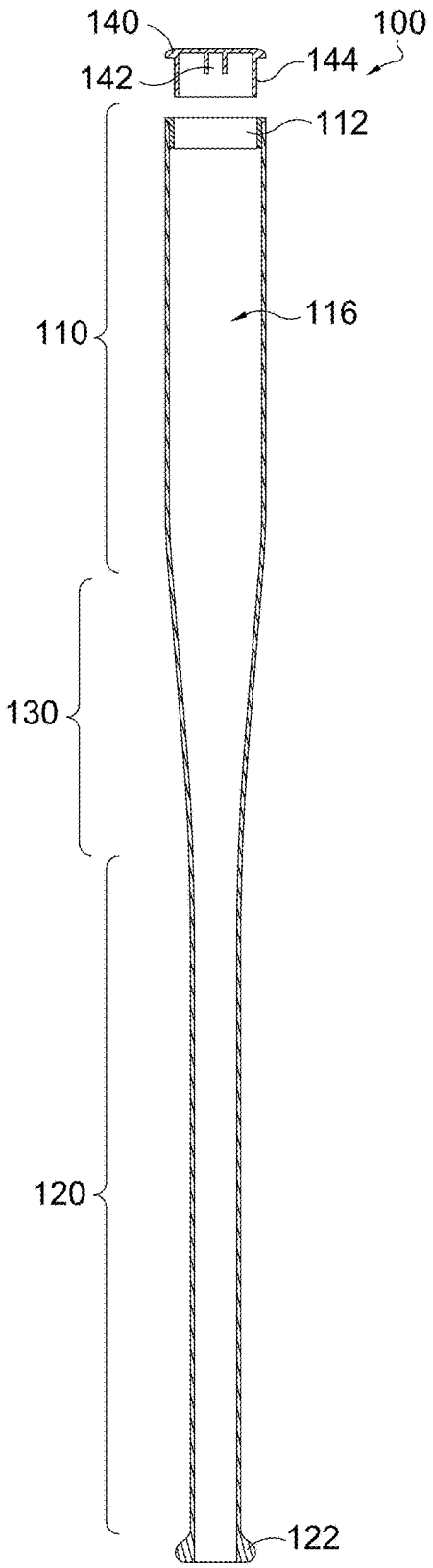

With initial reference to FIGS. 1A and 1B, an exemplary bat 100 including certain aspects of the present invention is shown. Bat 100 may include a longitudinal axis and include a barrel portion 110, a handle portion 120, a tapered portion 130 joining barrel portion 110 and handle portion 120. Bat 100 may be manufactured from wood or metal such as, but not limited to, aluminum or composite materials. Further, barrel portion 110 defines a hollow cavity 116 with an end cap 140 disposed at the end of barrel portion 110.

Figure 3:
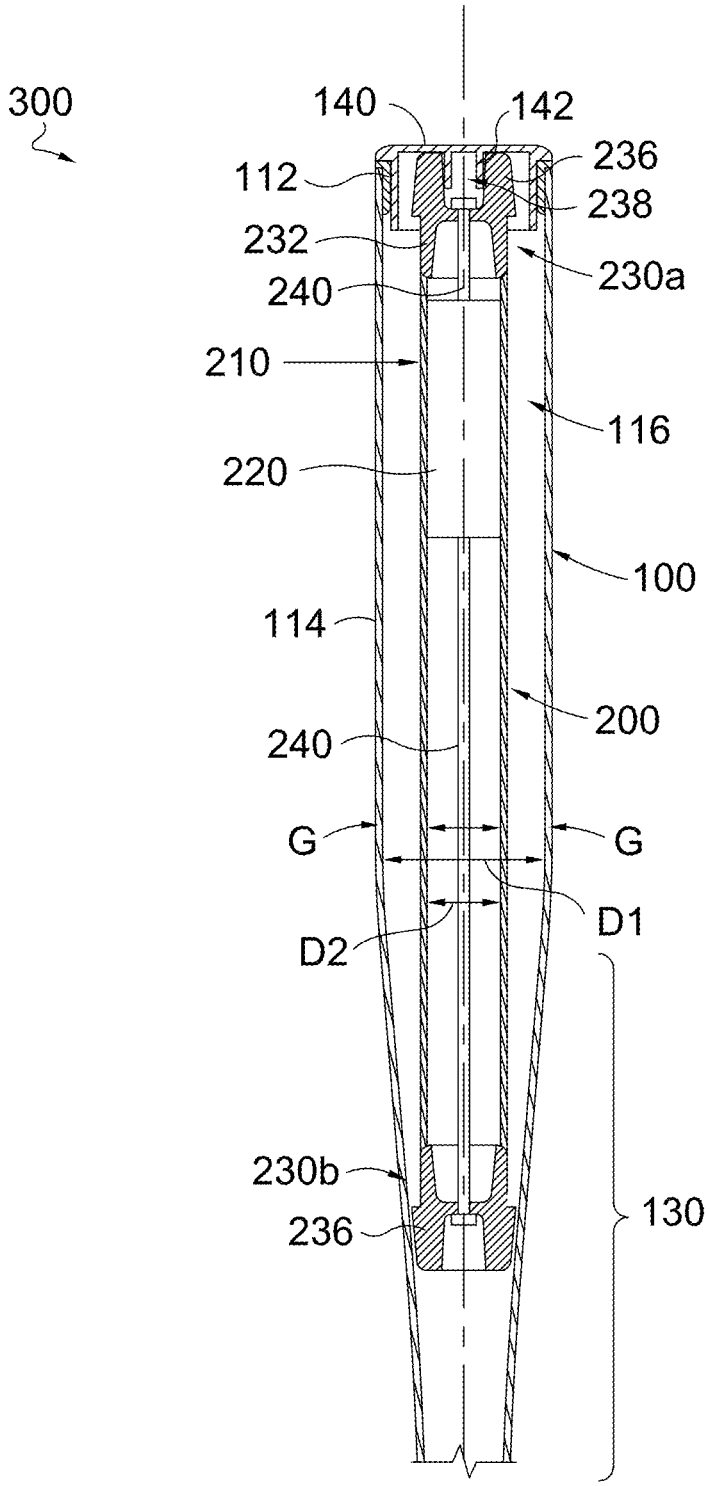
FIG. 3 illustrates a cross-sectional view of a ball bat including a barrel portion with a hollow cavity and an insertable adjustment cylinder secured within, in accordance with certain embodiments.

In particular, barrel portion 110 includes an outer wall 114 defining hollow cavity 116 having an inner diameter D1 (FIG. 3). In certain embodiments, outer wall 114 may be thinner than an outer wall of a traditional metal bat. Accordingly, bat 100 may be characterized as having a lighter weight when compared to the weight of a traditional bat due to thinner outer wall 114 and hollow cavity 116. For example, bat 100 may be 10 ounces lighter than a traditional bat when hollow cavity 116 is empty and end cap 140 is removably secured to barrel portion 110. A lighter bat or an underweight bat may in certain circumstances provide muscle conditioning and development skills when training for higher swing speeds.

Barrel portion 110 may further include an attachment collar 112 rigidly affixed to an internal surface of hollow cavity 116 at the end of bat 110 opposite tapered portion 130. Handle portion 120 is configured to be held by the user when swinging bat 100 to strike a ball. Handle portion 120 may be smaller in diameter than barrel portion 110. In some embodiments, handle portion 120 may be solid throughout. Handle portion 120 may further include a knob 122 which is a wider piece designed to keep the bat from slipping from the user's hands.

Tapered portion 130 is configured to join barrel portion 110 and handle portion 120. Tapered portion 130 may have a variable diameter as it extends from barrel portion 110 and handle position 120. In particular, the diameter at one end of tapered portion 130 is configured to match a diameter of barrel portion 110 where tapered portion 130 and barrel portion 110 are joined. Further, the diameter of tapered portion 130 at the other end of tapered position 130 is configured to match a diameter of handle portion 120 where tapered portion 130 and handle portion 120 are joined. In certain embodiments, tapered portion 130 may be entirely hollow, entirely solid, or transition from having a hollow cavity near barrel portion 110 to having a solid interior near handle portion 120.

Bat 100 may further include end cap 140 configured to be removably coupled with and cover an end of hollow cavity 116 of barrel portion 110 opposite tapered portion 130. End cap 140 may include at least one protrusion 142 and a lower lip 144. Protrusion 142 may be cylindrical or prismatic in shape. End cap 140 may be further configured to be removably coupled with attachment collar 112. For example, end cap 140 may include threads disposed on an outer surface of lower lip 144. Attachment collar 112 may include a threaded inner surface configured to receive corresponding threads disposed on an outer surface of lower lip 144 of end cap 140. However, any suitable attachment means between attachment collar 112 and the outer surface of lower lip 144 of end cap 140 may be utilized.

Figures 2A, 2B, 2C:
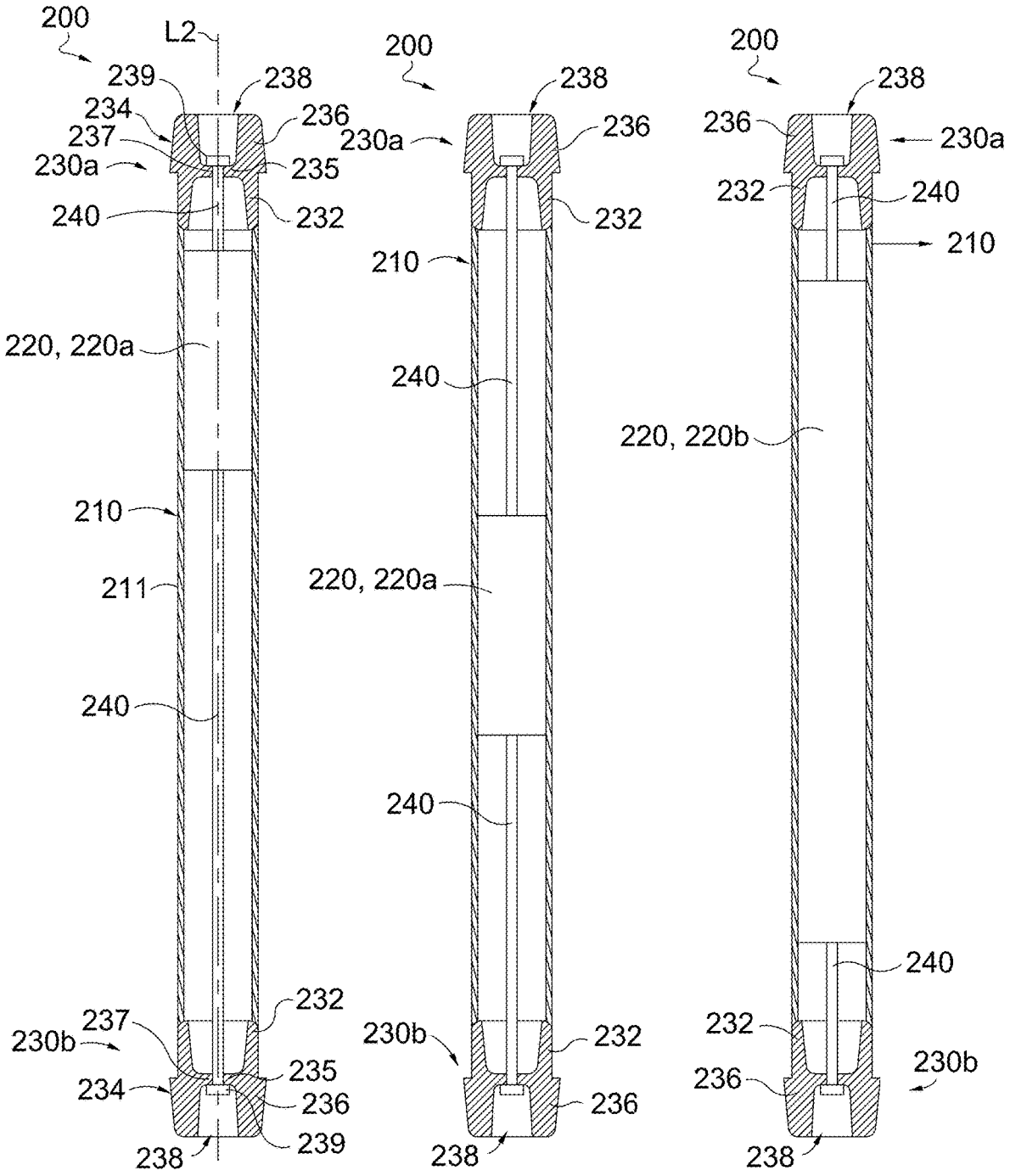
FIGS. 2A-2C illustrate a cross-sectional view of insertable adjustment cylinders, in accordance with some embodiments.

FIGS. 2A-2C illustrate a cross-sectional view of an insertable adjustment member 200 that may be used with bat 100 in accordance with certain embodiments of the present invention. Insertable adjustment member 200 may include a hollow cylindrical body 210, at least one weight 220, two crowns 230*a*, 230*b*, and a shaft 240 that extends between crowns 230 and is disposed through the at least one weight 220. The at least one weight 220 may extend along a longitudinal axis L2 of hollow cylindrical body 210. Further. When insertable adjustment member 200 is disposed within cavity 116, the longitudinal axis L2 of hollow cylindrical body 210 is colinear with the longitudinal axis L1 of bat 100.

It should be understood that hollow cylindrical body 210 is configured to be positioned within hollow cavity 116 defined in barrel portion 110 of bat 100. For example, hollow cylindrical body 210 may have an outer diameter between 1 inch and 2 inches (2.54-5.08 centimeters). Hollow cylindrical body 210 may be constructed of aluminum, polymer, or any other suitable material. Further, it should be understood that cylindrical body 210 may include an outer surface 211 that has a diameter D2 that is less than inner diameter D1 of cavity 116, whereby a gap G is defined therebetween (FIG. 3).

Weight 220 is configured to be inserted into hollow cylindrical body 210. In certain embodiments, weight 220 may be cylindrically-shaped, and may comprise a single weight or two or more weights. If two or more weights are used, they may be in direct contact with one another, separated by spacers (not shown), or separated on different positions along shaft 240. The placement of weight 220 within hollow cylindrical body 210 is guided by shaft 240.

Weight 220 may have at least one channel defined therein that extends along its longitudinal axis between opposite ends thereof. The opening in weight 220 is configured to receive shaft 240. In exemplary embodiments, the opening may be a single centered opening that extends along the longitudinal axis of weight 220. In some embodiments, centered opening may be threaded and configured to receive corresponding threads defined on shaft 240. In some embodiments, the placement of weight 220 within hollow cylindrical body 210 of bat 100 may be user adjustable. For example, weight 220 may be rotated up or down threads of shaft 240. In other embodiments, weight 220 may have a fixed position along shaft 240. For example, weight 220 may be affixed to shaft 240 by welding, soldering, pining, or any other suitable means.

In some embodiments, insertable adjustment cylinder 200 may possess an uneven weight distribution with a larger percentage of weight disposed toward a single end of the adjustment member 200. That is, weight 220*a* may be positioned toward one end of cylindrical body 210, as illustrated in FIG. 2A. In other embodiments, adjustment member 220 may possess an even weight distribution throughout the rod or a centered weight distribution by placing weight 220*a*, 220*b*, as illustrated in FIGS. 20 and 28, respectively.

Crowns 230*a*, 230*b* may be removably coupled to a respective end of hollow cylindrical body 210. In other embodiments, one or both crowns 230*a*, 230*b* may be fixedly coupled to a respective end of hollow cylindrical body 210. Shaft 240 extends along the longitudinal axis of hollow cylindrical body 210 and extends between each of crowns 230*a*, 230*b* and through the opening of cylindrical weight 220 thereby securing crowns 230*a*, 230*b* to cylindrical weight 220 within the hollow cylindrical body 210.

Each of crowns 230*a*, 230*b* may include a lower portion 232 configured to engage an inner surface of hollow cylindrical body 210, and an upper portion 234. Upper portion 234 may include an outer surface 236 configured to engage with tapered portion 130 of bat 100, and an inner surface 238 configured to engage with end cap 140 as will be described further below. Crowns 230*a*, 230*b* also include a intermediate member 235 that has an aperture 237 defined therein that is configured for allowing a respective end of shaft 240 to be disposed therein. Each end of shaft 240 includes a head 239 that has a diameter that is greater than a diameter of aperture 237 to assist with maintaining the position of shaft 240 within hollow cylindrical body 210.

As best seen in FIG. 3, adjustment member 200 may be inserted into hollow cavity 116 of barrel portion 110 and secured in place with end cap 140 to form a bat swing training system 300. Bat swing training system 300 includes bat 100 and at least one insertable adjustment member 200. Each insertable adjustment member 200 is configured to be individually inserted in hollow cavity 116 of barrel portion 110 of bat 100. Each insertable adjustment member 200 is configured to be secured between tapered portion 130 and end cap 140. The hollow cavity 11 has a first diameter D1.

A center portion of the lower surface of end cap 140 may include at least one protrusion 142. Additionally, inner surface 238 of upper portion 234 of crown 230*a* may include at least one recess configured to engage with at least one protrusion 142 disposed on the center portion of the lower surface of end cap 140. As noted above, at least one protrusion 142 may be cylindrical or prismatic in shape. Accordingly, inner surface 238 of upper portion 234 may define at least one cylindrical or prismatic recess configured to receive a corresponding cylindrically or prismatic shaped at least one protrusion 142. In exemplary embodiments, when end cap 140 is secured to barrel portion 110 via attachment collar 112, at least one protrusion 142 will mate with the at least one recess of inner surface 238 of upper portion 234 thereby securing insertable adjustment cylinder 200 at one end thereof.

Outer surface 236 of upper portion 234 of crown 230*b* is configured to engage with tapered portion 130 of ball bat 100. Outer surface 236 may have a diameter slightly larger than the inner diameter of hollow cylindrical body 210. Outer surface 236 may be generally conical in shape with a slope that generally matches a slope of tapered portion 130 thereby securing insertable adjustment cylinder 200 from a second end thereof. Accordingly, when end cap 140 is secured to barrel portion 110 via attachment collar 112, insertable adjustment cylinder 200 is held securely in place when bat 100 is swung.

Additionally, bat swing training system 300 may include a plurality of insertable adjustment members 200. The plurality of insertable adjustment members 200 may include insertable adjustment members of different weights and different centers of gravity. The plurality of insertable adjustment members 200 may include insertable adjustment members of incremental weights. For example, the plurality of insertable adjustment members may include rods weighing 5 ounces (141.7 grams), 10 ounces (283.5 grams), 15 ounces (425.2 grams), and 20 ounces (567 grams). Additionally, as discussed above and as illustrated in FIGS. 2A-2C, some adjustment members of plurality of insertable adjustment members 200 may have the same weight but different centers of gravity. For example, bat swing training system 300 may include two or three differently balanced insertable adjustment members 200 for each of a plurality of different weights enabling overweight training and underweight training for a variety of centers of gravity.

Figure 4A:
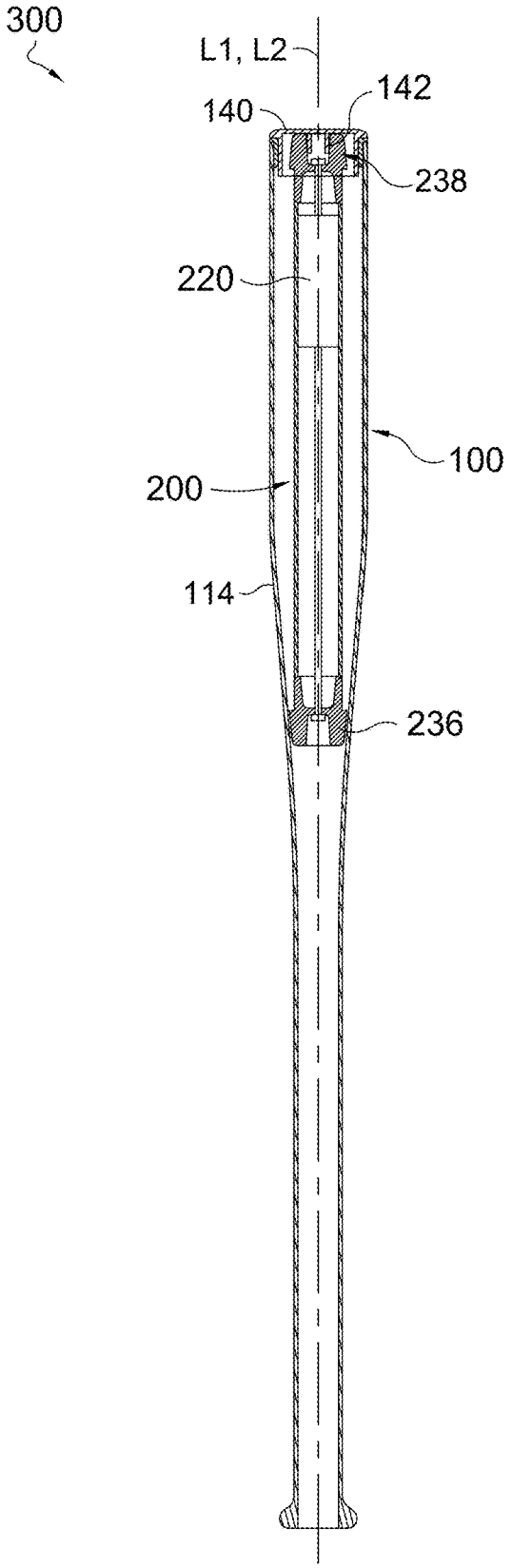
FIGS. 4A-4B illustrate a cross-sectional view of a bat swing training system including a ball bat with a barrel portion including a hollow cavity and an insertable adjustment cylinder secured in a first position and a second position, in accordance with some embodiments.
Figure 4B:
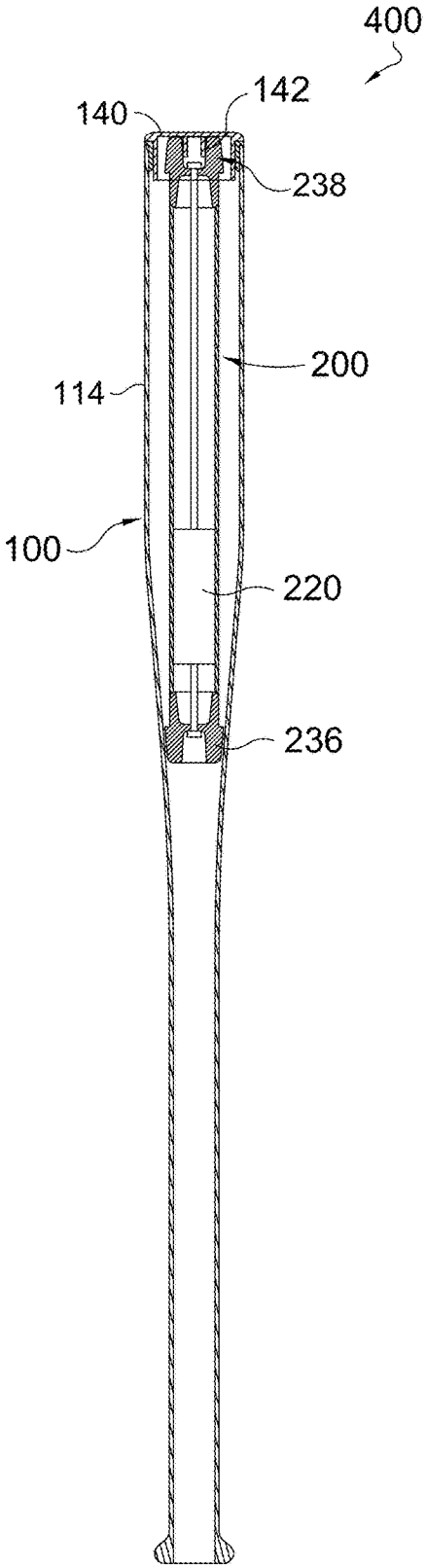

FIGS. 4A-4B illustrate a cross-sectional view of a bat swing training system 300 including a bat with a barrel portion including a hollow cavity and an insertable adjustment member secured in a first position and a second position, respectively. Referring to FIGS. 4A-4B, since crowns 230*a*, 230*b* may be identical, a single insertable adjustment member 200, with an uneven weight distribution where a larger percentage of weight is disposed toward a single end of the adjustment member, may be inserted in a first position placing a larger percentage of weight toward top cap 140 to make bat 100 have a top-heavy center of gravity. The same single insertable adjustment member 200 may be inserted in a second position, rotated 180 degrees from the first position, placing a larger percentage of weight toward taper portion 130 to make bat 100 have a bottom-heavy center of gravity.

Bat 100 is further configured to be functional for striking a ball with or without insertable adjustment member 200 being secured within the barrel. Accordingly, bat swing training system 300 provides an improved system and device for modifying the weight and center of gravity of the bat while maintaining its functional ability to strike a ball thereby providing functional progressive training for improving swing speed.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description set forth herein has been presented for purposes of illustration and description, but is not intended to be exhaustive or limited to the form disclosed. While the invention has been described by reference to various specific embodiments, it should be understood that numerous changes may be made within the spirit and scope of the inventive concepts described. Many modifications and variations will be apparent to those of ordinary skill in the art without departing from the scope and spirit of the disclosure. The embodiment was chosen and described in order to best explain the principles of one or more aspects set forth herein and the practical application, and to enable others of ordinary skill in the art to understand one or more aspects as described herein for various embodiments with various modifications as are suited to the particular use contemplated. Accordingly, it is intended that the invention not be limited to the described embodiments, but will have full scope defined by the language of the following claims.

Based on the foregoing, a ball bat and a bat swing training system have been disclosed in accordance with the present invention. However, numerous modifications and substitutions can be made without deviating from the scope of the present invention. Therefore, the present invention has been disclosed by way of example and not limitation.

What is claimed is:

1. A bat including a first longitudinal axis, the bat comprising:

a handle portion;

a barrel portion having an outer wall defining a first cavity, wherein the barrel portion includes a first end and a second end, and wherein the second end provides access to the first cavity;

a tapered portion disposed between and connecting the first end of the barrel portion and the handle portion;

an end cap removably coupled with the second end of the barrel portion; and an insertable adjustment member disposed in the first cavity, wherein the insertable adjustment member comprises:

a cylindrical body defining a second cavity and having a second longitudinal axis, wherein the cylindrical body includes a first end and a second end;

a weight disposed in the second cavity, wherein the weight defines an opening that extends along the second longitudinal axis;

a first crown coupled to the first end of the cylindrical body, wherein the first crown is engaged with the end cap;

a second crown coupled to the second end of the cylindrical body, wherein the second crown is engaged with the tapered portion; and a shaft extending along the second longitudinal axis, wherein the shaft is disposed in the opening of the weight, wherein the shaft includes a first distal end and a second distal end, wherein the first distal end is engaged with the first crown, wherein the second distal end is engaged with the second crown, and wherein the shaft only extends between the first crown and the second crown, and wherein the cylindrical body, the weight, the first crown, the second crown, and the shaft are removable from the first cavity as a single unit.

2. The bat in accordance with claim 1, further comprising:

an attachment collar rigidly affixed to an internal surface of the second end of the barrel, wherein the end cap is removably coupled with the attachment collar.

3. The bat in accordance with claim 2, wherein the attachment collar comprises a threaded inner surface configured to receive corresponding threads disposed on an outer surface of a lower lip of the end cap.

4. The bat in accordance with claim 1, wherein the weight is adjustably positioned along the second longitudinal axis.

5. The bat in accordance with claim 4, wherein the second longitudinal axis is colinear with the first longitudinal axis.

6. The bat in accordance with claim 1, wherein each of the first crown and the second crown comprise:

a lower portion configured to engage an inner surface of the cylindrical body; and an upper portion comprising an outer surface configured to engage with the tapered portion and an inner surface configured to engage with a lower surface of the end cap.

7. The bat in accordance with claim 6, wherein the lower surface of the end cap comprises at least one protrusion; and wherein the inner surface of the upper portion comprises at least one recess configured to engage with the at least one protrusion of the lower surface of the end cap.

8. The bat in accordance with claim 7, wherein the at least one protrusion of the end cap comprises a single cylindrical protrusion, and wherein the at least one recess of each of the first and second crowns comprises a single cylindrical recess configured to receive the single cylindrical protrusion.

9. The bat in accordance with claim 1, wherein the insertable adjustment member comprises an even weight distribution.

10. The bat in accordance with claim 1, wherein the insertable adjustment member comprises an uneven weight distribution with a larger percentage of weight disposed toward a single end of the adjustment member.

11. The bat in accordance with claim 1, wherein the at least one weight is selectively positionable within the second cavity along the second longitudinal axis.

12. The bat in accordance with claim 1, wherein the first cavity has a first diameter, wherein the insertable adjustment member includes an outer surface having a second diameter, and wherein a gap is defined between the first diameter and the second diameter.

13. The bat in accordance with claim 1, wherein the insertable adjustment member is disposed in the first cavity at a first orientation or a second orientation;

at the first orientation, the weight is located at a first position relative to the first longitudinal axis; and at the second orientation, the weight is located at a second position relative to the first longitudinal axis.

14. A bat swing training system comprising:

a bat including a first longitudinal axis, the bat comprising:

a handle portion, a barrel portion having an outer wall defining a first cavity, wherein the barrel portion includes a first end and a second end, and wherein the second end provides access to the first cavity, a tapered portion disposed between and connecting the first end of the barrel portion and the handle portion, an end cap removably coupled with the second end of the barrel portion; and a plurality of insertable adjustment members each configured to be disposed in the first cavity, wherein each of the plurality of insertable adjustment members comprise:

a cylindrical body defining a second cavity and having a second longitudinal axis, wherein the cylindrical body includes a first end and a second end;

a weight disposed in the second cavity, wherein the weight defines an opening that extends along the second longitudinal axis;

a first crown coupled to the first end of the cylindrical body, wherein the first crown is engaged with the end cap;

a second crown coupled to the second end of the cylindrical body, wherein the second crown is engaged with the tapered portion;

a shaft extending along the second longitudinal axis, wherein the shaft is disposed in the opening of the at least one weight, wherein the shaft includes a first distal end and a second distal end, wherein the first distal end is engaged with the first crown, and wherein the second distal end is engaged with the second crown, wherein the shaft only extends between the first crown and the second crown, and wherein the cylindrical body, the weight, the first crown, the second crown, and the shaft are removable from the first cavity as a single unit.

15. The system in accordance with claim 14, wherein the bat further comprises an attachment collar rigidly affixed to an internal surface of the second end of the barrel, wherein the end cap is removably coupled with the attachment collar.

16. The system in accordance with claim 15, wherein the attachment collar comprises a threaded inner surface configured to receive corresponding threads disposed on an outer surface of a lower lip of the end cap.

17. The system in accordance with claim 14, wherein the weight is adjustably positioned along the second longitudinal axis.

18. The system in accordance with claim 14, wherein each of the first and second crowns comprises:

a lower portion configured to engage an inner surface of the cylindrical body; and an upper portion comprising an outer surface configured to engage with the tapered portion and an inner surface configured to engage with a lower surface of the end cap.

19. The system in accordance with claim 18, wherein the lower surface of the end cap comprises at least one protrusion; and wherein the inner surface of the upper portion comprises at least one recess configured to engage with the at least one protrusion of the lower surface of the end cap.

20. The system in accordance with claim 19, wherein the at least one protrusion of the end cap comprises a single cylindrical protrusion, and wherein the at least one recess of each of the first and second crowns comprises a single cylindrical recess configured to receive the single cylindrical protrusion.

21. The system in accordance with claim 14, wherein at least one of the plurality of insertable adjustment members comprises an even weight distribution.

22. The system in accordance with claim 14, wherein at least one of the plurality of insertable adjustment members comprises an uneven weight distribution with a larger percentage of weight disposed toward a single end of the adjustment member.

23. The system in accordance with claim 14, wherein the plurality of insertable adjustment members comprise insertable adjustment members of different weights.

24. The system in accordance with claim 14, wherein the shaft is threaded, and wherein the opening of the at least one weight is threaded and configured to receive the threads of the shaft.

25. The system in accordance with claim 14, wherein the first cavity has a first diameter, wherein at least one of the insertable adjustment members includes an outer surface having a second diameter, and wherein a gap is defined between the first diameter and the second diameter.

26. The system in accordance with claim 14, wherein each of said insertable adjustment members is disposed in the first cavity at a first orientation or a second orientation;

at the first orientation, the weight is located at a first position relative to the first longitudinal axis; and at the second orientation, the weight is located at a second position relative to the first longitudinal axis.

* * * * *